US005707144A

United States Patent [19]

Gampe et al.

[11] Patent Number: 5,707,144

[45] Date of Patent: Jan. 13, 1998

[54] LAMP HOUSING FOR SURGICAL LAMP

[75] Inventors: Uwe Gampe, Floersheim; Berthold Gerhart, Moembris; Stefan Maier, Weiterstadt; Rudolf Marka, Darmstadt, all of Germany

[73] Assignee: Heraeus Med GmbH, Hanau, Germany

[21] Appl. No.: 738,309

[22] Filed: Oct. 25, 1996

[30] Foreign Application Priority Data

Jan. 24, 1996 [DE] Germany ..... 196 02 329.7

[51] Int. Cl.[6] ..... F21V 21/00

[52] U.S. Cl. ..... 362/374; 362/33; 362/375; 362/804

[58] Field of Search ..... 362/33, 310, 311, 362/362, 374, 375, 804, 370

[56] References Cited

U.S. PATENT DOCUMENTS

| | | | |
|---|---|---|---|
| 2,344,327 | 3/1944 | Runge . | |
| 3,626,170 | 12/1971 | Schwan . | |
| 4,617,619 | 10/1986 | Gehly . | |
| 4,937,714 | 6/1990 | Witt | 362/804 |
| 5,274,535 | 12/1993 | Gonser . | |

FOREIGN PATENT DOCUMENTS

| | | |
|---|---|---|
| 2318577 | 9/1978 | Australia . |
| 805078 | 11/1936 | France . |
| 1952358 | 7/1970 | Germany . |
| 36 33 609 | 4/1987 | Germany . |

OTHER PUBLICATIONS

Hanaulux Duo Surgical Lamp Operation Manual, pp. 1–32, Print No. 56351038/02.92 Ko. Heraeus Instruments GmbH, Hanau, Germany, (1992).

*Primary Examiner*—Y My Quach

*Attorney, Agent, or Firm*—Frishauf, Holtz, Goodman, Langer & Chick, P.C.

[57] ABSTRACT

A lamp housing for a surgical lamp having a light exit opening at one end thereof, an access opening disposed on a side opposite from the light exit opening and a cover member for closing the access opening. The cover member is attached to a pivotable spring member located in the interior of the housing. The cover member is held in the access opening through spring action by a flange-type circumferential flange on the inside of an edge surrounding the access opening. The spring member is a leaf spring connected to the cover member and is pivotably hinged to the interior of the lamp housing. By applying external pressure to the cover member, the cover member is inserted into the housing and shifted along the interior of the lamp housing by a swivel motion to the extent that access, for example, for changing the bulb, without difficulty.

11 Claims, 3 Drawing Sheets

LAMP HOUSING FOR SURGICAL LAMP

BACKGROUND OF THE INVENTION

1. Field of the Invention

The present invention pertains to a lamp housing for a surgical lamp with a housing opening which can be closed by means of a cover piece, the cover piece being connected with the housing by a spring member which permits the cover piece to be swivelled.

1. Background Information

U.S. Pat. No. 2,344,327 discloses a lamp housing whose reflector opening can be closed by means of a light transmitting cover plate. The cover plate is connected with the rest of the lamp housing by means of a hinge equipped with a spring, whereby additional retaining devices for locking the cover piece are provided. This is a relatively elaborate locking mechanism, which, when operational interference occurs during use, such as, for example, the need to replace the bulb, trained staff is required. Moreover, the locking elements located in the area of the outer periphery of the lamp housing are, due to their complex construction, not suitable for surgical lamps, since surgical lamps require very high expenditures for sterilization purposes. Moreover, surgical lamps necessitate that surfaces thereof be as smooth as possible to obtain quick and reliable sterilization.

In order to change bulbs in the Hanaulux 2000 Duo Surgical Lamp (see the Hanaulux 2000 Duo Surgical Lamp operation manual, Print No.: 56351038/02.92 Ko), a housing cap attached to the rearside of the lamp housing must be removed and then placed back in position; in doing so, a twisting safety mechanism must be operated.

SUMMARY OF THE INVENTION

An object of the present invention is to provide a lamp housing for surgical lamps which not only has a simple construction, but enables easy access into the housing interior, for example, for changing a bulb.

A further object of the present invention is to provide a lamp housing having surfaces that are as smooth as possible for easy sterilization.

The above objects, as well as other objects, advantages and aims, are satisfied by the present invention.

The present invention concerns a lamp housing for a surgical lamp comprising:

- an outer housing having a light exit opening and an access opening disposed on a side of the outer lamp housing facing away from the light exit opening;
- a cover member which is disposed inside of the outer housing to open and close the access opening, the cover member having a lower surface thereof with a peripheral area greater than the peripheral area of the access opening; and
- a spring member connected to the cover member, the spring member being pivotable relative to the outer housing, the spring member being pivotably retained at opposite ends thereof at positions located at an interior of the outer housing; the spring member urging the cover member from the inside of the lamp housing towards the outside of the lamp housing against an edge of the access opening by externally directed pressure of the spring member, thereby closing the access opening.

BRIEF DESCRIPTION OF THE DRAWINGS

For the purposes of illustrating the present invention there is shown in the drawings forms which are presently preferred. It is to be understood, however, that the present invention is not limited to the precise arrangements and instrumentalities depicted in the drawings.

DETAILED DESCRIPTION OF THE INVENTION

Figure 1:
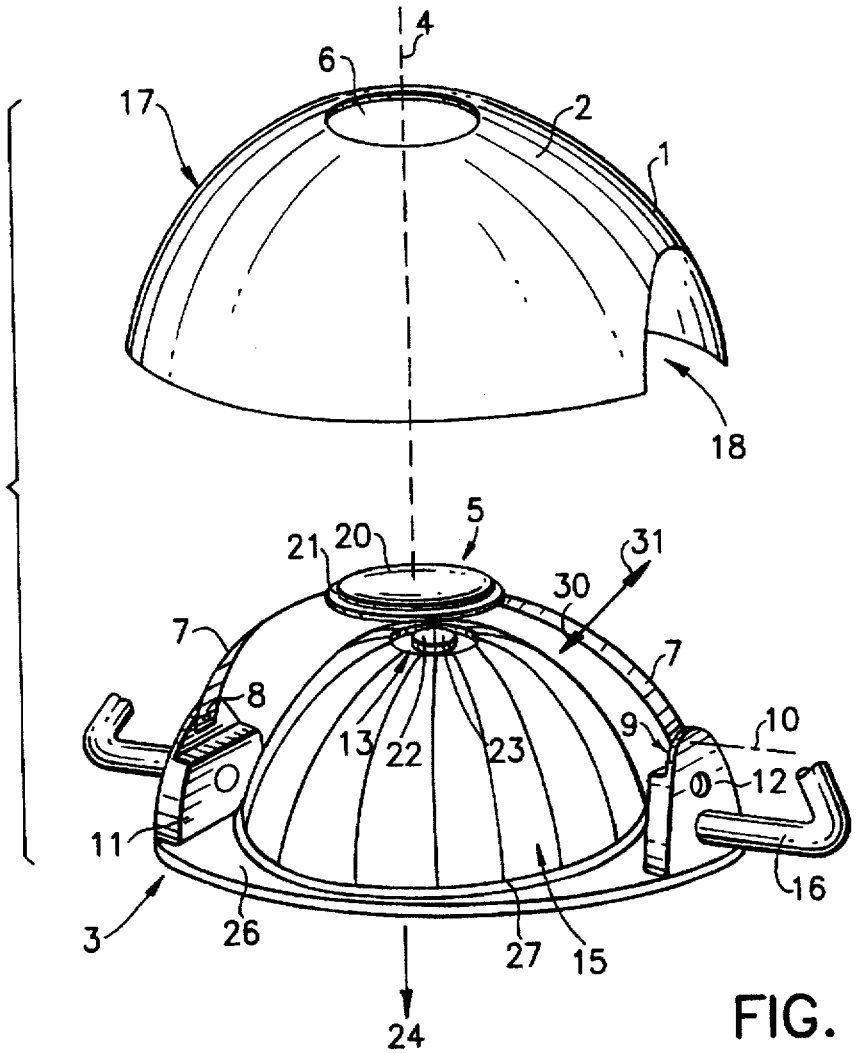
FIG. 1 shows an exploded perspective view of the parts of the lamp housing prior to its assembly.

FIG. 1*a* shows an exploded view of the lamp housing 1 prior to its assembly, with an outer housing (dome) 2 shown removed from the lower housing member 3. The dome 2 can be made of a synthetic material (such as a plastic), and can be in a shape of a paraboloid-type hollow body which is bent convexly towards the outside. The dome 2 is provided with an access opening 6 in the apex area along the longitudinal axis 4 of the lamp housing 1.

The access opening 6 is closeable by a spring-supported cover member 5 by means of pressure exerted from the inside thereof. The cover member 5 is connected with the lower housing member 3 of the lamp housing 1 via a spring member or spring element (such as a leaf spring) 7. The spring member 7 is retained at each of its ends by pivot bearings 8 and 9, respectively, of the lower housing part 3, in such a manner that the spring member 7 can be swung together with the cover member 5 attached to it, not only towards the access opening 6, but also away from the access opening 6. The spring member 7 can comprise two elongated leaf springs in a S-curve shape to facilitate bending when is pushed down. The pivot bearings 8 and 9 are arranged on the oppositely disposed interior surfaces of supporting elements 11, 12, respectively, of the lower housing part 3, along a swivelling (latitudinal) axis 10. At least one of the two supporting elements 11, 12 is provided for the swivel-type attachment of the lamp housing 1 to a hinged bracket 16 of a ceiling suspension, which hinged bracket 16 is only partially shown in FIG. 1.

The interior surface of the reflector 15, which is located on the lower housing member 3, is preferably cylindrically symmetrical and preferably has a hollow paraboloid shape. The axis extending through the opening 13 of the reflector corresponds to the longitudinal axis 4 of the dome 2. In the opening 13, two projector lamps (not shown in FIG. 1) can be inserted and can be arranged parallel to each other. One of the projector lamps can serve, for example, as the main lamp, and a second of the projector lamps can serve as the spare lamp. Upon failure of the main lamp, a changeover can take place to supply electricity to the spare lamp by an automatic changeover switch (not shown in the figures) located in lamp housing 1, including an appropriate signal indication (not shown in the figures).

As discussed hereinabove, the lamps are not shown in FIG. 1, but FIG. 1 shows bases 22, 23, respectively of the lamps, for insertion of the bulbs in the direction of the light exit 24.

The dome is provided with two laterally oppositely disposed convex surfaces 17, 18, which seal the interior of the lamp housing 1 towards the outside when it is locked into position through its placement onto the supporting elements 11, 12 and the lower housing member 3. The cover member 5 contains a circular cover 20, which is provided in its lower surface with a circumferential flange 21, with the lower housing member 3 being connected in a form-fitting manner to the dome 2 by the spring member 7.

Figure 2:
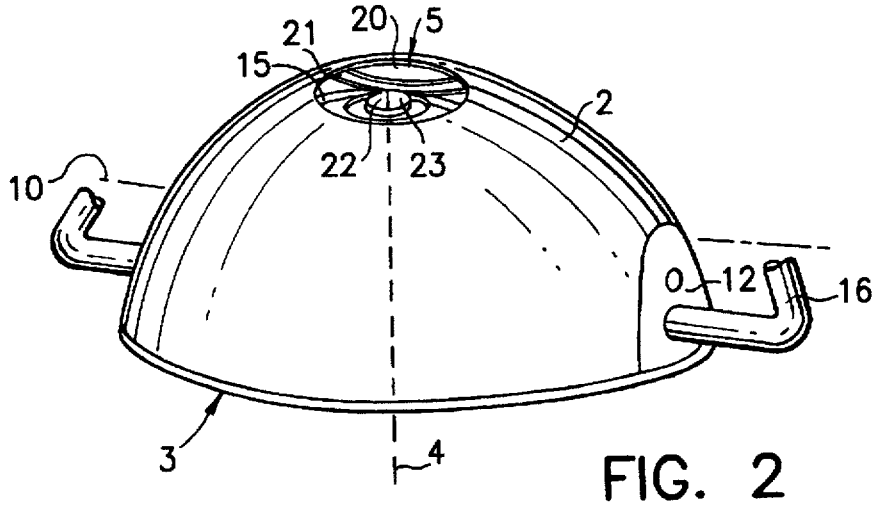
FIG. 2 shows a perspective view of the assembled lamp housing, with the housing access opening having been opened by shifting a cover member to provide access for changing the bulb or bulbs.

As seen in to FIG. 2, when placing the dome 2 onto the lower housing part 3, the cover 20 of the cover member 5 enters the opening 6 of the dome 2, while the circumferential flange 21 is pressed against the inner edge of the opening 6 in such a manner that its closing is actuated by the action of spring member 7. The cover member 5 thus has a raised portion, which is cover 20, which is substantially the same size as the access opening. The cover 20 also has a flange (or lip) 21 disposed at the bottom surface of the raised portion (cover) 20, which extends outwardly for engaging the underside of the dome 2 when in a closed position to present a smooth, substantially continuous outside surface of the closed dome. In doing so, the outer surface of the dome 2 and the outer surface of the cover 20 together form a virtually closed exterior surface, which is an advantageous feature for meeting the sterilization requirements needed in operating rooms.

The lower housing member 3 contains a frame 26 supporting the supporting elements 11, 12, as well as a reflector 15 and a transparent window (not shown in FIG. 2). The frame 26 is equipped with fastening devices 27 for mounting the reflector 15 and the transparent window, as well as fastening devices for securing the dome 2 into position, which are not shown. Thus, a tight seal can be provided at the light exit opening 24 by the transparent window (which is not shown in FIG. 2). For the purpose of offering a better view in FIG. 2, the electrical lines required to supply the lamps with power are not shown.

Problem-free changing of a bulb or bulbs is made possible by applying pressure to the cover member 5 along axis 4, whereby a deformation of the spring member 7 results, so that the cover 20 of the cover member 5 is pressed under the edge of the access opening 6 of the dome 2 and can be shifted in a swivelling direction with respect of the spring member 7 around the axis 10 underneath the edge of the access opening 6. Thus it is relatively easy to carry out a changing of one of the bulbs or both bulbs, having bases 22, 23, respectively, by shifting the cover member 5.

It is possible for cover member 5 to be moved so as to swivel in the direction of the arrows designated by 30, 31, that is, around axis 10. After proper insertion of bulbs 28, 29 having bases 22, 23, respectively (the bulbs 28, 29 are shown in FIG. 3*a*), the cover member 5 can be manually returned to its original position along axis 4, so that the access opening 6 is closed by the cover 20 of the cover member 5.

Figure 3A:
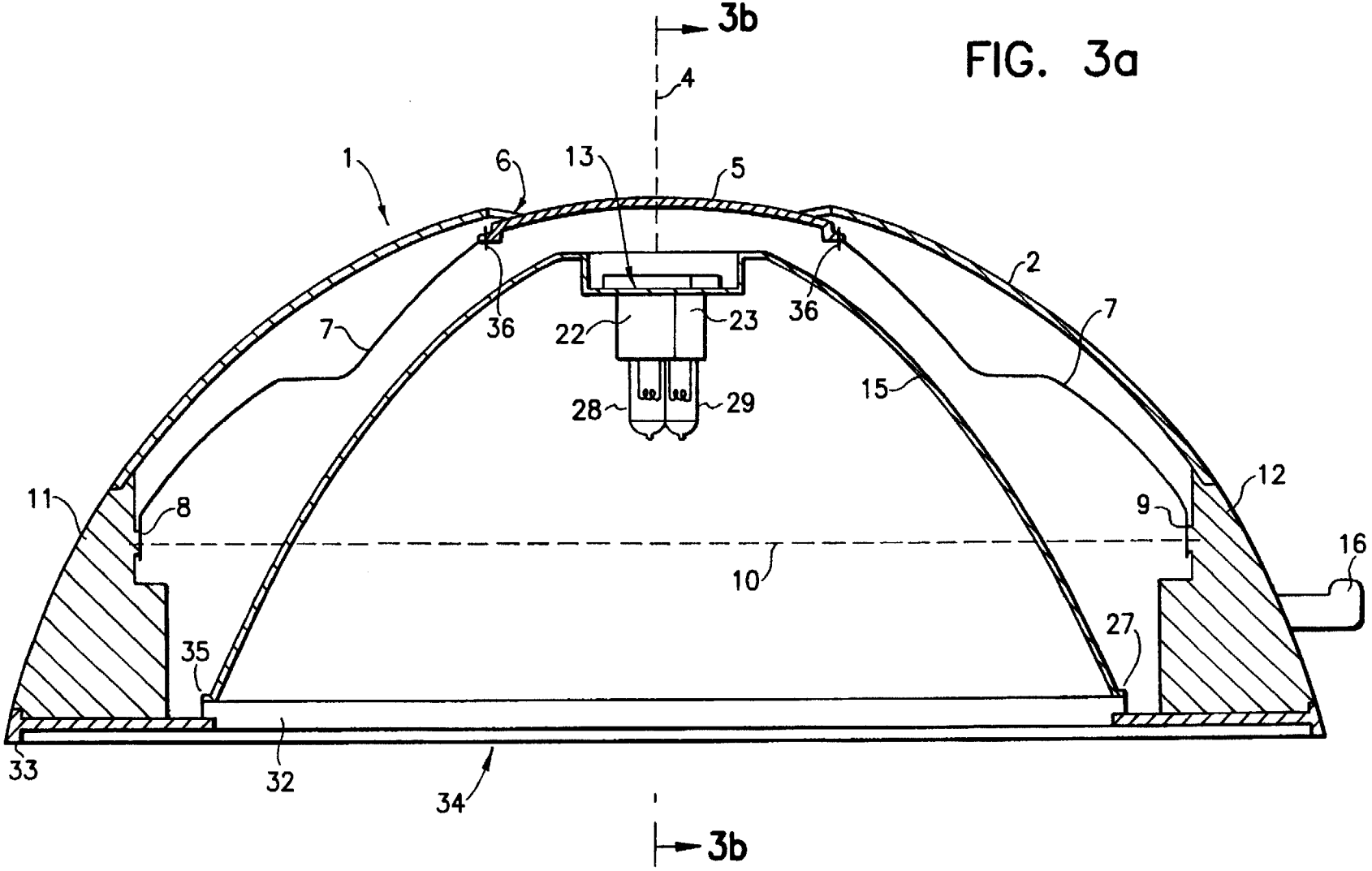
FIG. 3*a* is a sectional view through the housing along the swivelling axis 10.

FIG. 3*a* shows a section through the lamp housing 1 along axis 10. Reflector 15 is supported by the flange-type edge 35 on the edge of transparent window 32, which in turn covers the edge 33 of the opening 34 of the lamp housing 1. The circumferential flange type edge 35 of the reflector 15 is retained together with the edge of the transparent window 32 in the area of edge 33 of the lamp housing 1 by means of screws or pins, thereby sealing the opening 34 of the lamp housing 1 in order to meet the strict hygienic requirements of operating rooms.

FIG. 3*a* shows a gap between the edge area of opening 6 of the dome 2 and the edge area of the cover member 5, which usually results when pressure is exerted along axis 4 onto the cover member 5. It is then possible to swing the cover member 5 around swivelling axis 10 to such an extent that manual access through the access opening 6 of the dome 2 is possible, thus providing ease of changing the bulbs.

The supporting of the spring member 7 occurs by the bearings 8 and 9 of the supporting elements 11, 12, respectively, along axis 10. In opening 13 of the reflector 15, both bulbs 28, 29 can be seen, having bases 22, 23, respectively. To attach the entire lamp housing 1 in a standard swivel arm bracket, for example, the hinged bracket 16 is provided.

Figure 3B:
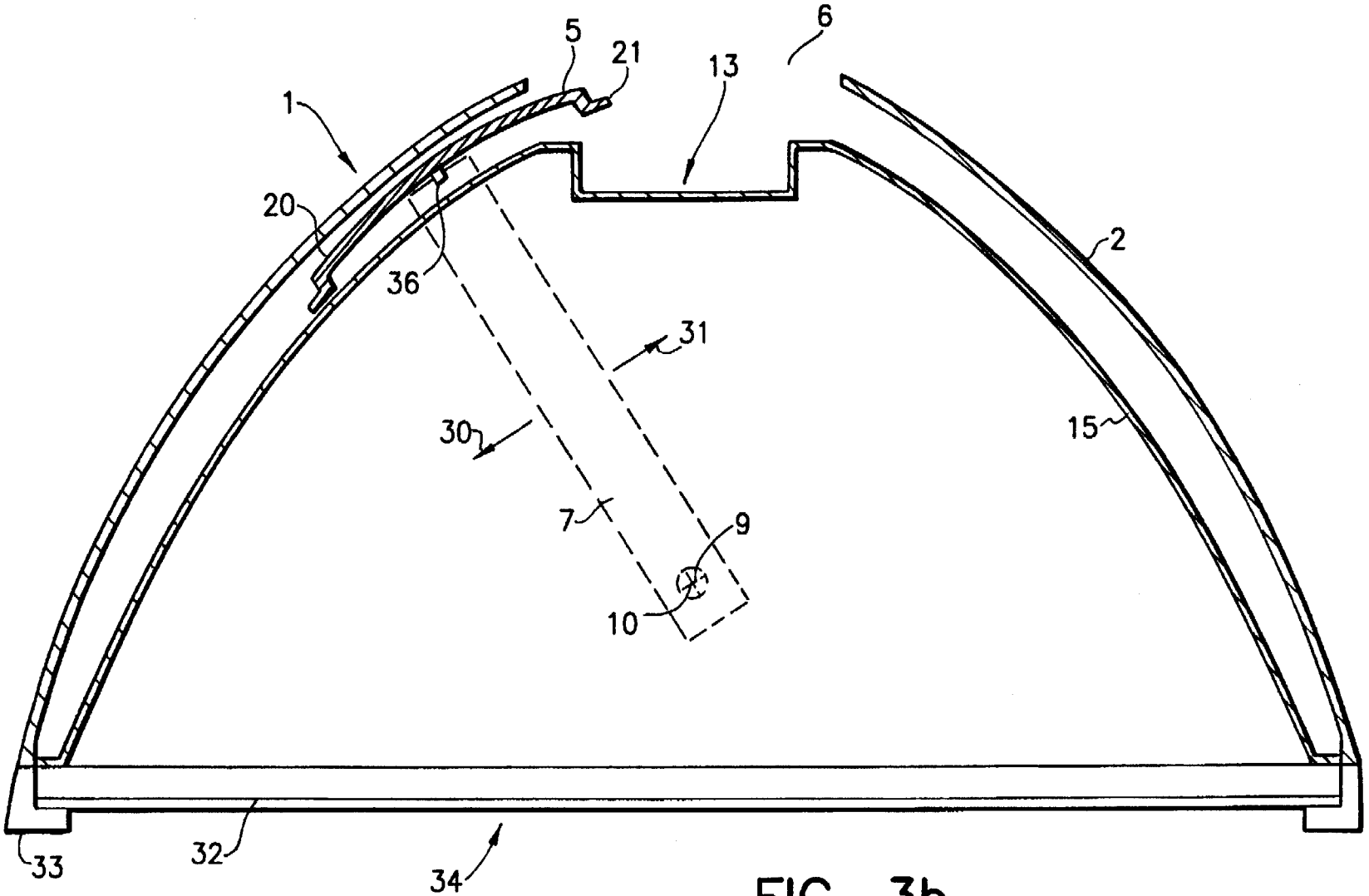
FIG. 3*b* is a sectional view taken along line 3*b*—3*b* in FIG. 3*a* which shows the lamp housing without the bulbs therein, and which shows the cover member displaced for bulb replacement.

FIG. 3*b* shows a section through lamp housing 1 which is rotated by 90° with respect to FIG. 3*a*. Certain features shown in FIG. 3*a* are not depicted in FIG. 3*b*. The spring member 7 which is pivotably connected to supporting element 12 (not shown in FIG. 3*b*) by pivot bearing 9 moves around swivelling axis 10. The cover 20 attached to spring member 7 thus can be moved to pass over opening 13 of the reflector 15. As can be seen in FIG. 3*b*, the cover member 5 is firmly connected with spring member 7 in a form-fitting fashion by retention pins 36, whereby access through the access opening 6 of the dome 2 takes place by laterally shifting the cover member 5 in one of the two swivelling directions 30, 31.

A particularly advantageous feature of the present invention is the ease of handling, for example, especially when bulbs are changed by technically inexperienced staff. Furthermore, the strict requirements with respect to the sterility of equipment used in operating rooms can be met relatively easily due to the smooth, closed housing surfaces.

Changing bulbs is thus possible without using tools. When opening the lamp housing, it is advantageous that its center of gravity and mass are maintained.

It will be appreciated that the instant specification is set forth by way of illustration and not limitation, and that various modifications and changes may be made without departing from the spirit and scope of the present invention.

What is claimed is:

1. A lamp housing for a surgical lamp comprising:

an outer lamp housing having a light exit opening and an access opening, said access opening disposed on one end of said outer lamp housing facing away from said light exit opening;

a cover member which is disposed inside of said outer housing opening and closing said access opening, said cover member having a lower surface with a peripheral area greater than a peripheral area of said access opening; and a spring member connected to said cover member, said spring member being pivotable relative to said outer lamp housing, said spring member pivotably retained at opposite ends thereof at positions located at an interior of said outer lamp housing; said spring member urging said cover member from the inside of the outer lamp housing towards an outside of the outer lamp housing and urging said lower surface inside said outer lamp housing against a peripheral edge of said access opening, by externally directed pressure of said cover member and said spring member, thereby closing said access opening.

2. The lamp housing according to claim 1, which further comprises a lower housing member having a light exit opening at one end thereof, a transparent window at an end opposite to the access opening and a reflector, said reflector and the outer lamp housing are placed and locked in position on the lower housing member.

3. The lamp housing according to claim 2, wherein the lower housing member is provided with at least one hinged bracket to support the outer lamp housing.

4. The lamp housing according to claim 2, wherein the reflector has a paraboloid shape.

5. The lamp housing according to claim 2, wherein the reflector has a paraboloid shape; the spring member comprises two elongated springs, each having an S-curve shape; and the outer lamp housing is a dome having a paraboloid shape.

6. The lamp housing according to claim 5, wherein the lower housing member is provided with at least one hinged bracket to support the outer lamp housing.

7. The lamp housing according to claim 1, wherein the cover member comprises a cover for projecting into the access opening and a circumferential flange disposed on said lower surface of the cover which is pressed against the peripheral edge of the access opening in a closed position closing the access opening.

8. The lamp housing according to claim 1, wherein the outer lamp housing comprises a dome shaped synthetic material injection-molded member.

9. The lamp housing according to claim 1, wherein the spring member comprises two elongated leaf springs, each having an S-curve shape.

10. The lamp housing according to claim 9, wherein the cover member comprises an upper raised portion substantially a same size as the access opening and a lower flange portion on said lower surface extending outwardly from the raised portion for engaging an underside of the outer lamp housing.

11. The lamp housing according to claim 10, wherein the cover member has a circular shape.

* * * * *